United States Patent [19]

Rannenberg

[11] 4,201,405

[45] May 6, 1980

[54] PERPETUAL OR LONG LIFE CALENDAR

[76] Inventor: Katherine Rannenberg, Cedaridge Rd., Canton, Conn. 06022

[21] Appl. No.: 897,398

[22] Filed: Apr. 18, 1978

[51] Int. Cl.[2] ..... G09D 3/00; B42D 5/04

[52] U.S. Cl. ..... 283/4; 40/107; 40/119

[58] Field of Search ..... 283/2, 3, 4; 40/107, 40/119

[56] References Cited

U.S. PATENT DOCUMENTS

| | | | |
|---|---|---|---|
| 868,878 | 10/1907 | Marshman | 40/119 |
| 959,479 | 5/1910 | Doolittle | 283/4 |
| 1,236,974 | 8/1917 | Orth | 40/119 |
| 1,494,133 | 5/1924 | Ringler | 40/107 |
| 1,798,656 | 3/1931 | Chapman | 283/3 X |
| 2,160,104 | 5/1939 | Kalow | 40/119 |

FOREIGN PATENT DOCUMENTS

| | | | |
|---|---|---|---|
| N 5724 | 10/1955 | Fed. Rep. of Germany | 40/119 |
| 944155 | 6/1956 | Fed. Rep. of Germany | 40/119 |
| 314375 | 6/1934 | Italy | 40/119 |
| 41437 | 10/1907 | Switzerland | 40/119 |
| 426220 | 3/1935 | United Kingdom | 40/119 |
| 1163032 | 9/1969 | United Kingdom | 40/119 |

*Primary Examiner*—Paul A. Bell

*Attorney, Agent, or Firm*—Norman Friedland

[57] ABSTRACT

The useful life of a calendar is extended by reusing all portions which repeat from year to year. The calendar assembly consists of two separately bound groups of pages: one bearing the names of the months and the other bearing the various combinations of days of the month, arranged in such a manner that the calendar is easy to use and has the minimum number of sheets of paper used in its construction.

4 Claims, 3 Drawing Figures

PERPETUAL OR LONG LIFE CALENDAR

BACKGROUND OF THE INVENTION

1. Field of Invention

This invention relates to calendars of the type which consist of a stack of pages bound on one edge, each showing the name of a month together with the appropriate calendar for that month.

2. Description of Prior Art

Since antiquity, one of the most common forms of calendar has consisted of a single stack of pages, each page stating both the name of a month and together with it the appropriate calendar for that month. The complete calendar assembly is usually bound together at the top, making it suitable for hanging on a wall. The pages are turned by the user so as to expose the months in sequence, one at a time. The most commonly used assembly consists of 12 pages (sometimes printed on both sides of 6 sheets) so that the calendar assembly has a useful life of one year. Each year of life doubles the number of sheets required.

SUMMARY OF THE INVENTION

An object of the invention is provision for an improved monthly calendar assembly with extended useful life.

The invention consists of a single assembly composed of two separate stacks of pages, the pages of each stack capable of being turned separately on a flexible binding at the top of each stack.

One of the two stacks of the assembly consists of pages, each of which bears one of the various combinations of individual monthly calendar possible. Only 28 monthly configurations are possible, since there are only 4 different length months (28, 29, 30, and 31 days) and only 7 different starting days of the week (Monday, Tuesday, Wednesday, Thursday, Friday, Saturday, Sunday). Seven times four yields 28 possible month calendar configurations.

The other stack of the two stacks of the assembly consists of pages, each of which bears the name of one of the months January, February, March, April, May, June, July, August, September, October, November, December.

One uniqueness of the invention is in its construction whereby all pages of the stack containing the monthly calendars are arranged so that all calendars of 30 days length face in the same direction as the adjacent stack containing the month names of 30 day months, that is April, June, September, and November. In a like manner when the entire assembly is rotated 180 degrees on its vertical axis to look at the backside of the sheets, the calendars having 31 days are adjacent to, and facing in the same direction as the sheets having the names of the months containing 31 days, that is January, March, May, July, August, October, and December. By printing names of the months, and the 30 day and 31 day month calendars, on both sides of the paper in this manner, the cost and thickness of the complete assembly is reduced.

A further reduction in the cost and thickness of the complete assembly may be achieved by printing the month name February twice in the months' name stack so that it faces both in the direction the 30 day months' face, and also in the direction the 31 day months' face. This enables the various combinations of 28 and 29 day calendars to also be printed alternately on both sides in the stack of pages containing the monthly calendars, further minimizing the total number of sheets of paper required.

A "key" table listing the appropriate calendar for any given month for any year is included in the assembly. Such a table is easily compiled by whoever desires to publish the calendar of this invention, using commonly available sources of such information. The "key" table may be printed on a sheet separate from the month names and month calendars, but is preferably printed twice so it may be read from either side of the assembly.

The user of the calendar first looks at the "key" table to determine the appropriate calendar for the month he desires, and turns over the leaves of the calendar stack to expose this specified page. He then turns over the leaves of the name of the month stack to the desired month name. Because of the unique construction of this invention the selected name of the month and appropriate calendar for this month will both appear adjacent to each other and facing in the same direction. The calendar is then hung on the wall or used in the conventional manner.

DESCRIPTION OF THE PREFERRED EMBODIMENT

Figure 1:
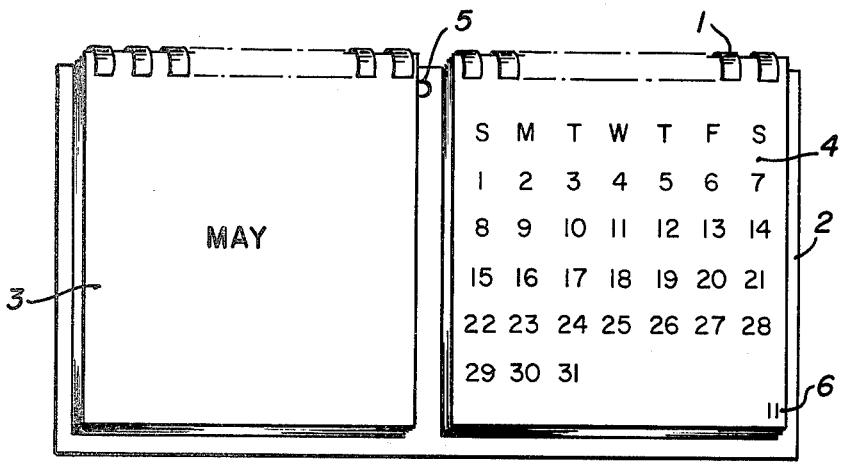
FIG. 1 is a plain view showing the invention.
Figure 3:
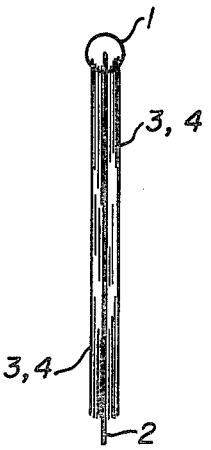
FIG. 3 is a side view.
Figure 2:
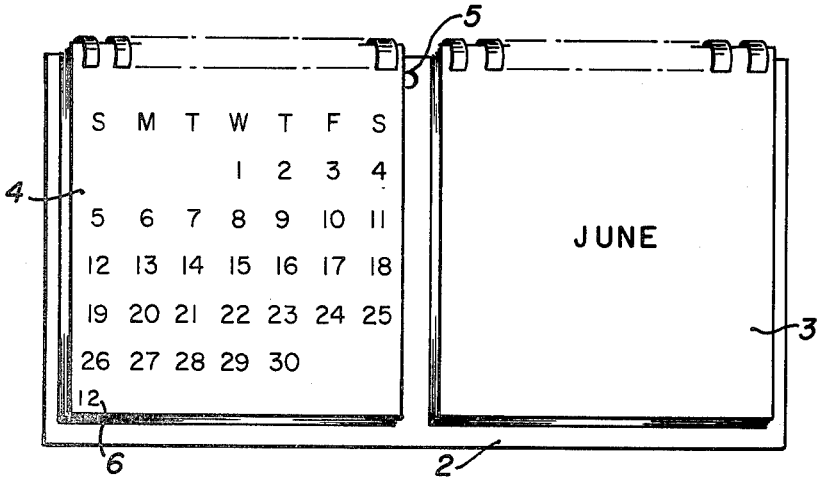
FIG. 2 is also a plain view rotated 180 degrees or backside of the calendar.

Views of a typical embodiment of the invention are shown on FIGS. 1 to 3. The "name of the month" sheets 3 and the "month calendar" sheets 4 are bound together at the top by commercially available hinge or the like such that each stack of sheets may be turned separately. A structural member in this case a sheet of stiffer paper or cardboard 2, is also held by the binding 1, and acts to hold the stacks in position. It is understood that the structural member (2) may be eliminated from the assembly if the binding 1 has sufficient strength to maintain the stacks 3 and 4 in position. Opening 5 serves to hang the calendar on the wall or the like. As noted, FIG. 1 could be the front side and FIG. 2 could be the back side.

The "key" table is calculated for a given length of time, say for twenty-eight years, enabling the user to select the right key indicated by reference numeral 6 for the month calendar 4 of a given year. The "Key Table" for 1977 to 1983 is as below. This can be increased accordingly and gives the user infinite life of the calendar.

As for example, FIG. 1 shows the key 6 as reading numeral 11 which corresponds to 1977 of the row and May of the column in the below Table 1. Calendar days for the other months are similarly obtained from the "Key Tables" listed below, which can be obtained commercially or laboriously worked out. The selection of the key corresponding to the months versus years has been carefully made in this instance so that when applied generally keeps the pages in the calendar successive so that ease of use is facilitated. It will be noted that the order is repeatable every twenty-eight years so that the Key Table for the year 2005 is the same as for the year 1977, 2006 is the same as 1978, and so on.

Table 2 illustrates how the "month calendar" pages (reference numeral 4 in FIGS. 1 and 2) are constructed and the order in which they are stacked. For example, Table 2 indicates that the front side of the first sheet consists of a 31 day month calendar starting on Wednesday and labled with Key Numeral 1. The back side of the first sheet consists of a 30 day month calendar starting on Saturday and labeled with the Key 3. By proceeding in a like manner down Table 2 to sheet 14, a "month calendar" stack will be constructed providing a calendar of infinite life, since all 28 possible monthly calendars will be incorporated. In the interest of reducing the cost and thickness of the assembly of a calendar stack of less than 14 sheets may be utilized at the expense of reducing calendar life. Table 2 indicates that the use of 8 sheets will result in a two year life, 10 sheets will result in a 6 year life, 12 sheets will result in an 11 year life, and 14 sheets will result in infinite life.

Table 3 illustrates how the "name of the month" pages (reference numeral 3 in FIGS. 1 and 2) are constructed and the order in which they are stacked. For example, under column labeled Sheet No., the No. 1 sheet front and back will be Jan. and February, respectively. Sheet 2, front and back will be February and blank (no month) as this accounts for the oddness February has with respect to the other months. By stacking the months in the manner of Table 3, the total number of "name of the month" sheets will be 8 regardless of the number of sheets selected for the "month calendar" stack.

TABLE 1

TYPICAL "KEY" TABLE

| | JAN | FEB | MAR | APR | MAY | JUN | JUL | AUG | SEP | OCT | NOV | DEC | |
|---|---|---|---|---|---|---|---|---|---|---|---|---|---|
| 1977 | 5 | 20 | 9 | 10 | 11 | 12 | 13 | 3 | 4 | 5 | 6 | 7 | 1977 |
| 1978 | 11 | 15 | 1 | 2 | 3 | 4 | 5 | 9 | 10 | 11 | 12 | 13 | 1978 |
| 1979 | 3 | 16 | 7 | 8 | 9 | 10 | 11 | 1 | 2 | 3 | 4 | 5 | 1979 |
| 1980 | 9 | 17 | 5 | 6 | 7 | 8 | 9 | 13 | 14 | 1 | 2 | 3 | 1980 |
| 1981 | 7 | 18 | 11 | 12 | 13 | 14 | 1 | 5 | 6 | 7 | 8 | 9 | 1981 |
| 1982 | 13 | 19 | 3 | 4 | 5 | 6 | 7 | 11 | 12 | 13 | 14 | 1 | 1982 |
| 1983 | 5 | 20 | 9 | 10 | 11 | 12 | 13 | 3 | 4 | 5 | 6 | 7 | 1983 |
| 1984 | 11 | 21 | 7 | 8 | 9 | 10 | 11 | 1 | 2 | 3 | 4 | 5 | 1984 |
| 1985 | 9 | 22 | 13 | 14 | 1 | 2 | 3 | 7 | 8 | 9 | 10 | 11 | 1985 |
| 1986 | 1 | 23 | 5 | 6 | 7 | 8 | 9 | 13 | 14 | 1 | 2 | 3 | 1986 |
| 1987 | 7 | 18 | 11 | 12 | 13 | 14 | 1 | 5 | 6 | 7 | 8 | 9 | 1987 |
| 1988 | 13 | 24 | 9 | 10 | 11 | 12 | 13 | 3 | 4 | 5 | 6 | 7 | 1988 |
| 1989 | 11 | 15 | 1 | 2 | 3 | 4 | 5 | 9 | 10 | 11 | 12 | 13 | 1989 |
| 1990 | 3 | 16 | 7 | 8 | 9 | 10 | 11 | 1 | 2 | 3 | 4 | 5 | 1990 |
| 1991 | 9 | 22 | 13 | 14 | 1 | 2 | 3 | 7 | 8 | 9 | 10 | 11 | 1991 |
| 1992 | 1 | 25 | 11 | 12 | 13 | 14 | 1 | 5 | 6 | 7 | 8 | 9 | 1992 |
| 1993 | 13 | 19 | 3 | 4 | 5 | 6 | 7 | 11 | 12 | 13 | 14 | 1 | 1993 |
| 1994 | 5 | 20 | 9 | 10 | 11 | 12 | 13 | 3 | 4 | 5 | 6 | 7 | 1994 |
| 1995 | 11 | 15 | 1 | 2 | 3 | 4 | 5 | 9 | 10 | 11 | 12 | 13 | 1995 |
| 1996 | 3 | 26 | 13 | 14 | 1 | 2 | 3 | 7 | 8 | 9 | 10 | 11 | 1996 |
| 1997 | 1 | 23 | 5 | 6 | 7 | 8 | 9 | 13 | 14 | 1 | 2 | 3 | 1997 |
| 1998 | 7 | 18 | 11 | 12 | 13 | 14 | 1 | 5 | 6 | 7 | 8 | 9 | 1998 |
| 1999 | 13 | 19 | 3 | 4 | 5 | 6 | 7 | 11 | 12 | 13 | 14 | 1 | 1999 |
| 2000 | 5 | 27 | 1 | 2 | 3 | 4 | 5 | 9 | 10 | 11 | 12 | 13 | 2000 |
| 2001 | 3 | 16 | 7 | 8 | 9 | 10 | 11 | 1 | 2 | 3 | 4 | 5 | 2001 |
| 2002 | 9 | 22 | 13 | 14 | 1 | 2 | 3 | 7 | 8 | 9 | 10 | 11 | 2002 |
| 2003 | 1 | 23 | 5 | 6 | 7 | 8 | 9 | 13 | 14 | 1 | 2 | 3 | 2003 |
| 2004 | 7 | 28 | 3 | 4 | 5 | 6 | 7 | 11 | 12 | 13 | 14 | 1 | 2004 |
| 2005 | 5 | 20 | 9 | 10 | 11 | 12 | 13 | 3 | 4 | 5 | 6 | 7 | 2005 |
| | JAN | FEB | MAR | APR | MAY | JUN | JUL | AUG | SEP | OCT | NOV | DEC | |

The above table lists the page number of the "month calender" stack to use for any given year and month until the year 2005. Enter year horizontally and month vertically. For example the page number to use for March, 1980 is page 5.

TABLE 2

TYPICAL CONSTRUCTION OF "MONT CALENDAR" STACK

| Make-up of sheets of "Month Calendar" Stack | | | | | | | | |
|---|---|---|---|---|---|---|---|---|
| Sheet No. | Table** 1 | Side* | Length of Month | First of Month On | | | | |
| 1 | 1 | front | 31 | Wed | ↑ | ↑ | ↑ | ↑ |
| 1 | 2 | back | 30 | Sat | ↑ | ↑ | ↑ | ↑ |
| 2 | 3 | front | 31 | Mon | ↑ | ↑ | ↑ | ↑ |
| 2 | 4 | back | 30 | Thr | ↑ | ↑ | ↑ | ↑ |
| 3 | 5 | front | 31 | Sat | ↑ | ↑ | ↑ | ↑ |
| 3 | 6 | back | 30 | Tue | ↑ | ↑ | ↑ | ↑ |
| 4 | 7 | front | 31 | Thr | Use of 8 | ↑ | ↑ | ↑ |
| 4 | 8 | back | 30 | Sun | sheets gives | ↑ | ↑ | ↑ |
| 5 | 9 | front | 31 | Tue | 2 year life | Use of 10 | ↑ | ↑ |
| 5 | 10 | back | 30 | Fri | ↓ | sheets gives | ↑ | ↑ |
| 6 | 11 | front | 31 | Sun | ↓ | 6 year life | Use of 12 | ↑ |
| 6 | 12 | back | 30 | Wed | ↓ | ↓ | sheets gives | ↑ |
| 7 | 13 | front | 31 | Fri | ↓ | ↓ | 11 year life | Use of 14 |
| 7 | 14 | back | 30 | Mon | ↓ | ↓ | ↓ | sheets gives |
| 8 | 15 | front | 28 | Wed | ↓ | ↓ | ↓ | infinite life |
| 8 | 16 | back | 28 | Thr | ↓ | ↓ | ↓ | ↓ |
| 9 | 17 | front | 29 | Fri | | ↓ | ↓ | ↓ |
| 9 | 18 | back | 28 | Sun | | ↓ | ↓ | ↓ |
| 10 | 19 | front | 28 | Mon | | ↓ | ↓ | ↓ |

TABLE 2-continued

TYPICAL CONSTRUCTION OF "MONT CALENDAR" STACK

| Make-up of sheets of "Month Calendar" Stack | | | | |
|---|---|---|---|---|
| Sheet No. | Table** 1 | Side* | Length of Month | First of Month On |
| 10 | 20 | back | 28 | Tue |
| 11 | 12 | front | 29 | Wed |
| 11 | 22 | back | 28 | Fri |
| 12 | 23 | front | 28 | Sat |
| 12 | 24 | back | 29 | Mon |
| 13 | 25 | front | 29 | Sat |
| 13 | 26 | back | 29 | Thr |
| 14 | 27 | front | 29 | Tue |
| 14 | 28 | back | 29 | Sun |

*Where Front is defined as the side of the assembly which 31 day months face, and back is defined as the side of the assembly the 30 day months face.
**Corresponds to the Key specified in "Key" Table 1.

TABLE 3

TYPICAL CONSTRUCTION OF "NAME OF THE MONTH" STACK

| Make-up of Sheets of "Name of the Month" Stack | | |
|---|---|---|
| Sheet No. | Side* | Month Name Imprinted |
| 1 | front | Jan |
| 1 | back | Feb |
| 2 | front | Feb |
| 2 | back | Blank |
| 3 | front | Mar |
| 3 | back | Apr |
| 4 | front | May |
| 4 | back | Jun |
| 5 | front | Jul |
| 5 | back | Blank |
| 6 | front | Aug |
| 6 | back | Sep |
| 7 | front | Oct |
| 7 | back | Nov |
| 8 | front | Dec |
| 8 | back | Blank |

*Where Front is defined as the side of the assembly which 31 day months face, and Back is defined as the side of the assembly the 30 day months face.

Having thus described typical embodiments of the invention, that which is claimed as new and to be secured by Letters Patent of the United States is:

1. A calendar having two separate but adjacent stacks of pages, a structural member upon which each stack is bound, the pages of each stack bound together at the top of and to said structural member with a binding so that any page of either stack may be exposed independently of the other stack, and may be rotated 360 degrees about its binding to expose either side of the page independently of the other stack, the axis of rotation of the pages of each stack around its binding being concentric, the pages of one stack each containing the indicia corresponding to the names of one of the months, January, February, March, April, May, June, July, August, September, October, November, December, the pages of the other stack each containing one of the various month calendar combinations of the numerical days of the month arranged by days of the week.

2. A calendar as in claim 1 wherein the pages of both independent stacks have indicia on both front and back sides such that the stack of the assembly containing calendars of months of 30 days length face in the same direction and are visible from the same side of the assembly as the month names of months containing 30 days (April, June, September, and November); and the calendars of months of 31 days length face in the same direction and are visible from the same side of the assembly as the month names of months containing 31 days (January, March, May, July, August, October, and December).

3. A calendar as in claim 2 wherein the stack of the assembly containing calendars of the numerical days of the month of 28 or 29 days length shall be printed alternately on both sides of the sheets, and the stack containing names of the months shall have the name February twice, once facing in the direction of the 30 day months and once in the direction of the 31 day months.

4. A calendar as in claim 2 wherein the pages of the stack of the assembly containing calendars of the numerical days of the month of 28 and 29 days shall be printed on only one side of the sheets, and the stack containing names of the months shall have the name February only once facing in the same direction as the month calendars of 28 and 29 days length.

* * * * *